United States Patent [19]

Kholmogorov et al.

[11] 4,070,892

[45] Jan. 31, 1978

[54] ARRANGEMENT FOR METAL WORKING BY ROLLING

[76] Inventors: Mikhail Vladimirovich Kholmogorov, ulitsa Trofimova, 20, kv. 50; Jury Vasilievich Katkov, 3 linia, 11, korpus 2, kv. 63; Alexandr Mikhailovich Gusev, Chernomorsky bulvar, 15, korpus 2, kv. 124, all of Moscow, U.S.S.R.

[21] Appl. No.: 753,415

[22] Filed: Dec. 22, 1976

[30] Foreign Application Priority Data

Dec. 30, 1975 U.S.S.R. ..... 2306934

[51] Int. Cl.[2] ..... B21B 31/16

[52] U.S. Cl. ..... 72/195; 29/130

[58] Field of Search ..... 101/248; 29/129, 130; 72/195; 74/438, 439, 440, 446

[56] References Cited

U.S. PATENT DOCUMENTS

| | | | |
|---|---|---|---|
| 530,949 | 12/1894 | Klatte | 72/195 |
| 1,868,385 | 7/1932 | Greenwood | 101/248 |

*Primary Examiner*—Lowell A. Larson
*Attorney, Agent, or Firm*—Fleit & Jacobson

[57] ABSTRACT

An arrangement for metal working by rolling, such as forging rolls, is known and belongs to the metal forming equipment. In such an arrangement, sector dies are mounted on parallel shafts, and there are provided devices for adjustably rotating the sector dies and for transmitting rotary motion thereto from the shafts, the devices being reciprocable along the shaft. Each device comprises a sleeve which is externally and internally provided with teeth arranged at an angle to the sleeve axis. The teeth of one surface of the sleeve are directed in opposition to the teeth of the other surface of the sleeve and they differ in number by at least one tooth. The shaft and the sector die are provided with splines for receiving the teeth and forming therewith a splined connection for transmitting rotary motion from the shafts to the sector dies. This construction enables rotation of the sector dies at any angle relative to the shaft and their adjustment with maximum accuracy thus considerably adding up to roll-shaping versatility of the arrangement for metal treatment by rolling.

2 Claims, 3 Drawing Figures

ARRANGEMENT FOR METAL WORKING BY ROLLING

Figure 3:
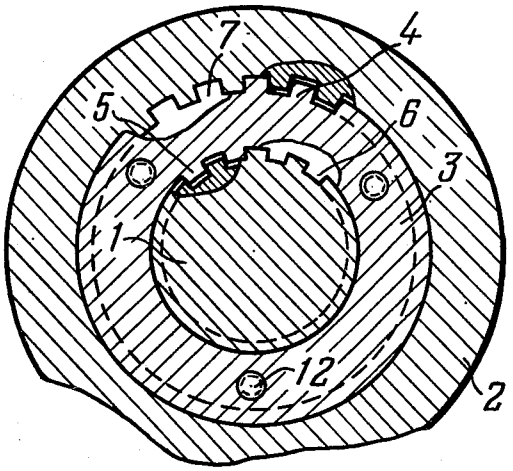

The invention relates to the equipment for metal working, and more particularly to arrangements for metal working by rolling, e.g. to forging rolls.

Arrangements for metal working by rolling, such as forging rolls are widely known and comprise parallel shafts supporting sector dies and devices for adjustably rotating the sector dies and for transmitting rotary motion thereto from the shafts, the devices being reciprocable along the shafts. Such arrangements may vary in construction.

Thus, USSR Inventor's Certificate No. 48077, CL. B 21b 31/30, describes a device comprising a shaped key having a projection in the form of an oblique parallelepiped. Two end faces of the projection extend in parallel with the end faces of the key, and two side faces are arranged at an angle to the side walls of the key. The prismatic part of the key is received in a longitudinal keyway provided in the shaft so as to reciprocate along the shaft. The cylindrical surface of the sector die facing the shaft has a slot for receiving the projection of the key which is movable along the slot. The slot is made at an angle to the axis of the cylindrical surface of the sector die and extends in the direction of the key projection.

Adjustable rotation of the sector die is effected by moving the key in the keyway along the shaft. Thus the key projection slides with the side face thereof along the side wall of the slot of the sector die to exert pressure thereto. The sector die is thereby rotated relative to the stationary shaft to take a pre-set position. The key is displaced along the shaft by means of a screw mounted in an arm rigidly secured to the die. The distal end of the screw is fixed to the end face of the key and may be rotated about the axis. The key also serves for transmitting rotary motion to the sector die from the shaft.

Therefore, in the known arrangements for metal working by rolling having the above-described adjustment device, the amount of rotation of the sector die relative to the shaft is limited by the angle of inclination of the key projection and by the amount of the key displacement along the shaft. In addition, in order to rotate the sector die at the maximum angle, the key should be displaced substantially along the entire length of the keyway so that the screw is to be too long thus making the device very cumbersome.

It is the main object of the invention to provide an arrangement for metal working by rolling having such a device for adjustably rotating a sector die and for transmitting thereto rotary motion from a shaft which enables adjustable rotation of the sector die at any angle relative to the shaft with minimum displacement along the shaft, thus considerably enlarging the manufacturing capabilities of forging rolls.

Another object of the invention is to ensure reliable operation of forging rolls.

The above and other objects are attained in an arrangement for metal working by rolling, wherein parallel shafts support sector dies and devices for adjustably rotating the sector dies and for transmitting thereto rotary motion from the shafts, the devices being reciprocable along the shafts, and wherein, according to the invention, each device comprises a sleeve which is externally and internally provided with teeth arranged on each surface of the sleeve at an angle to the sleeve axis in such a manner that the teeth of one of the surfaces extend.

This object is accomplished in an arrangement for in opposition to the teeth of the other surface and differ in number by at least one tooth, the shaft and the sector die being provided with splines for receiving the teeth of the sleeve.

This construction enables preliminary (rough) positioning of the sector die on the shaft at any pre-set position relative to the shaft.

Thus, so as the sector dies of forging rolls may be re-adjusted to suit any type and size of workpices with minimum time requirement, thereby adding to roll-shaping versatility of forging rolls and enhancing their efficiency. Owing to the opposite arrangement of the teeth of the inner and outer surfaces of the sleeve, the adjustment rotation of the sector die through a pre-set angle is effected along the sleeve for a distance which is twice as smaller as with the displacement in the prior art construction using the key with oblique projection so that the size of the device is considerably reduced and its reliability substantially improved.

It is preferable that the sleeve teeth extend substantially at 6° to the axis thereof.

This angle limit is defined by the angle of friction between lateral surfaces of the sleeve teeth and splines of the sector die.

This type of construction eliminates additional axial forces which may result in axial displacement of the sleeve and spontaneous rotation of the sector die. Thus the reliability of the device in operation is further improved.

Figure 1:
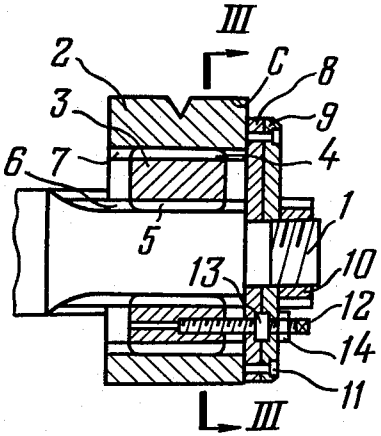
Figure 2:
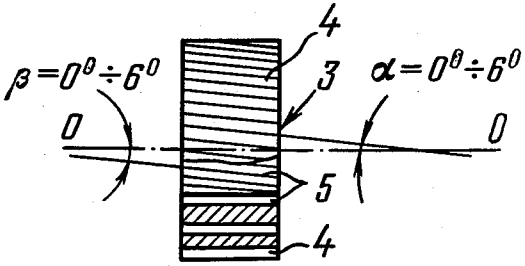

The invention will now be described in details with reference to a specific embodiment thereof illustrated in the accompanying drawings, in which:

FIG. 1 diagrammatically shows a longitudinal section of a part of an arrangement for metal working by rolling according to the invention, with a sector die and device for adjustably rotating the die and for transmitting rotary motion thereto from a shaft; and FIG. 2 is a partial sectional view of a sleeve, according to the invention;

FIG. 3 is an enlarged sectional view taken along line III—III in FIG. 1.

An arrangement for metal working by rolling is widely known, and, therefore, for the sake of clarity will not be described in detail. However, that part of the arrangement which directly relates to the inventive idea will be hereinbelow described with reference to the drawings.

Refereing now to the drawings, there is shown therein a shaft 1 of an arrangement for metal treatment by rolling (see FIG. 1) which supports a device for adjustably rotating a sector die 2, the device being disposed under the sector die 2 and serving for transmitting rotary motion from the shaft 1 to the die. According to the invention, this device comprises a sleeve 3 which is externally and internally provided with teeth 4 and 5, respectively. The teeth 4 extend along the sleeve 3 at an angle $\alpha$ to the axis 0—0 thereof as shown in FIG. 2. The angle $\alpha$ is equal to 6° . The teeth 5 extend at an angle $\beta$ to the axis 0—0 of the sleeve 3 in the direction opposite to that of the teeth 4 as shown in FIG. 2. The angle $\beta$ is also equal to 6°.

With the teeth 4 and 5 at the angles $\alpha$ and $\beta$ to the axis 0—0 of the sleeve which are greater than 6° , axial force would appear at the sleeve 3 during operation of the rolls to result in spontaneous displacement of the sleeve 3 along the shaft 1. This may cause misadjustment of the sector dies 2, hence in the production of defective parts. Therefore, an optimum value of the angles $\alpha$ and $\beta$ is 6° which corresponds to optimum angle of friction at which come into play axial forces to cause displacement of the sleeve 3 along the shaft 1, hence spontaneous rotation of the dies 2, is eliminated.

The teeth 4 and 5 may be of any cross-sectional shape appropriate for the purposes of the invention, such as triangular, rectangular, trapezoidal and the like.

The shaft 1 is provided with splines 6 such as shown in FIG. 3, for receiving the teeth 5 of the sleeve 3. The splines 6 extend in the direction toward the axis of the shaft 1 which coincides with the direction of the teeth 5, and are identical in cross-sectional shape with the teeth 5 as shown in FIG. 3.

The inner cylindrical surface of the sector die 2, mating the outer cylindrical surface of the sleeve 3, is provided with splines 7 for receiving the teeth 4 of the sleeve 3. The splines 7 are directed toward the axis of the sector die 2 just as the teeth 4. The teeth 4 and 5 form, in combination with the splines 7 and 6, respectively, spined connections for transmitting rotary motion from the shafts 1 to the sector dies 2. The number of teeth 4 is not equal to the number of teeth 5, and the difference therebetween is one tooth.

In forging rolls to be used in the manufacture of finished articles, the difference in number of the teeth 4 and 5 is one tooth.

In forging rolls to be used in the manufacture of forgings, the difference in number of the teeth 4 and 5 of the sleeve 3 is three teeth.

The shaft 1 is provided, at the distal end thereof, with a threaded portion supporting two washers 8 and 9. The washers 8 and 9 are urged against the end face "c" of the sector die 2 by means of a nut 10 (as shown in FIG. 1). The washers 8 and 9 are interconnected by means of screws 11 and are connected to the sleeve 3 by means of equally spaced adjustment screws 12 for axially displacing the sleeve 3 along the shaft 1 and for locking it in a pre-set position. One end of each screw 12 is screwed into the end face of the sleeve 3, and the other end extends through coaxial holes of the washers 8 and 9, such as shown in FIG. 1. Each screw 12 is provided with a collar 13, and the washers 8 and 9 have, at their opposite sides, grooves aligned with the holes defining a space for reception of the collar 13 as shown in FIG. 1. A lock nut is mounted on the distal end of each screw 12 to lock the screw 12 on the washer 9 and to prevent it from rotating about its axis.

The adjustment rotation of the sector die 2 is effected in the following manner.

The sleeve 3 is mounted on the shaft 1 (FIG. 1). The sector 2 is mounted on the sleeve 3 thus effecting rough positioning of the sector die 2 on the shaft 1. Then the washers 8 and 9 are mounted on the shaft 1, with the adjustment screws 12 received in their holes. The screws 12 are screwed into the end face of the sleeve 3. Then the nut 10 is run on the threaded portion of the shaft 1.

The sleeve 3 is displaced along the shaft 1 by rotating the screws 12. Thus the teeth 5 of the sleeve 3 are displaced in the splines 6 of the shaft 1. As a result, the sleeve 3 is caused to rotate in the direction corresponding to the inclination of the teeth 5.

At the same time, the teeth 4 of the sleeve 3 are displaced in the splines 7 of the sector die 2. Since the teeth 4 extend in the opposite direction relative to the axis of the sleeve 3 as compared to the teeth 5, the sector die 2 is caused to rotate relative to the sleeve 3 in the direction opposite to the that of the teeth 4. As a result, the directions of rotation of the sleeve 3 relative to the shaft 1 and of the sector die 2 relative to the sleeve 3 are identical. Therefore, the rotary motion of the sector die 2 relative to the shaft 1 is a total of rotatary motions of the sector die 2 relative to the sleeve 3 and of the sleeve 3 relative to the shaft 1.

After the adjustment rotation of the sector die 2 is completed, the adjustment screws 12 are locked by the lock nuts 14.

What is claimed is:

1. In an arrangement for metal working by rolling, comprising parallel shafts, sector dies mounted on said shafts and devices for adjustably rotating the sector dies and for transmitting rotary motion to the sector dies from the shafts, said devices being mounted on said shafts and being reciprocable therealong, wherein the improvement comprises each of said devices for adjustably rotating the sector dies and for transmitting rotary motion thereto from the shafts comprises a sleeve having external and internal surfaces and provided with teeth extending on the external and internal sleeve surfaces at an angle relative to the sleeve axis, the teeth of one of said surfaces extending in opposition to the teeth of the other of said surfaces and differing in number by at least one tooth, each of said shafts provided with first spline means for receiving the teeth of the sleeve extending on the inner surface thereof, and each of the sector dies provided with second spline means for receiving the teeth of the sleeve extending on the outer surface thereof.

2. An arrangement according to claim 1, wherein the sleeve teeth extend at an angle substantially of 6° relative to the axis thereof.

* * * * *